US006033155A

United States Patent [19]

Irvine et al.

[11] Patent Number: 6,033,155

[45] Date of Patent: Mar. 7, 2000

[54] REINFORCED STRUCTURE PANEL FOR FORMING BARRIER WALLS

[75] Inventors: John E. Irvine; John J. Yeosock, both of Atlanta, Ga.

[73] Assignee: Materials International, Inc., Atlanta, Ga.

[21] Appl. No.: 09/036,898

[22] Filed: Mar. 9, 1998

[51] Int. Cl.[7] ..... E02D 5/08; E02D 5/03

[52] U.S. Cl. ..... 405/281; 405/274; 405/276

[58] Field of Search ..... 405/262, 284, 405/286, 274, 278–281, 276, 277

[56] References Cited

U.S. PATENT DOCUMENTS

| | | | |
|---|---|---|---|
| 884,270 | 4/1908 | Fiero | 405/278 |
| 972,059 | 10/1910 | Clarke . | |
| 1,422,821 | 7/1922 | Boardman et al. . | |
| 1,679,800 | 8/1928 | Wemlinger . | |
| 1,884,686 | 10/1932 | Hilpert . | |
| 2,090,728 | 8/1937 | Heide . | |
| 2,968,931 | 1/1961 | McGrath . | |
| 3,247,673 | 4/1966 | Schneller . | |
| 3,822,557 | 7/1974 | Frederick . | |
| 3,999,392 | 12/1976 | Fukushima et al. . | |
| 4,632,602 | 12/1986 | Hovanian | 405/128 |
| 4,690,588 | 9/1987 | Berger | 405/262 |
| 4,808,039 | 2/1989 | Fischer | 405/281 |
| 4,863,315 | 9/1989 | Wickberg | 405/278 |
| 4,917,543 | 4/1990 | Cole et al. | 405/281 X |
| 5,066,353 | 11/1991 | Bourdo | 156/300 |
| 5,106,233 | 4/1992 | Breaux | 405/128 |
| 5,145,287 | 9/1992 | Hooper et al. | 405/242 |
| 5,163,785 | 11/1992 | Zanelli | 405/277 |
| 5,292,208 | 3/1994 | Berger | 405/281 |
| 5,333,971 | 8/1994 | Lewis | 405/281 |
| 5,360,293 | 11/1994 | Breaux | 405/267 |
| 5,388,931 | 2/1995 | Carlson | 405/274 |
| 5,580,191 | 12/1996 | Eagan | 405/262 |
| 5,584,610 | 12/1996 | Simpson et al. | 405/281 |

OTHER PUBLICATIONS

The Superior Way to Cut Costs and Increase Service Life—GeoGuard Vinyl Sheet Piling, by Materials International, Inc. (Pat. No. 5,145,287).

The First Choice, Shore Guard Vinyl Sheet Piling, by Materials International 1997.

*Primary Examiner*—Dennis L. Taylor

*Attorney, Agent, or Firm*—Thomas, Kayden, Horstemeyer & Risley

[57] ABSTRACT

Structural panels (12) of extruded PVC and of stretched Z-shaped configuration and which can be driven into the ground include strengthening ribs (36–40) extending from the inner surfaces (34 and 35) of the opposed side sections (26 and 27). The ribs extend at a right angle to the side section bending planes (56 and 57) and at a right angle to the panel bending plane (64), thereby adding significant resistance to both compression and tension forces applied to the panel. The structural panels are driven into the earth to form a wall barrier, with the female locking element (43) being telescopically moved along the male locking element (42) of a previously installed panel. Distal strengthening rib (40) functions as a driving tongue to stabilize the position of the male locking element (42) during driving of the panel into the ground.

14 Claims, 3 Drawing Sheets

REINFORCED STRUCTURE PANEL FOR FORMING BARRIER WALLS

FIELD OF THE INVENTION

This invention relates to extruded structural panels fabricated of synthetic resin material and which are useful as pilings for driving into the earth and for forming sea walls, piers, dikes, barrier walls and the like. The panels are stretched Z-shaped configuration in cross section and have opposed male and female locking elements at their opposite edges so that duplicate ones of the panels are connected together in side-by-side relationship to form the wall structure.

BACKGROUND OF THE INVENTION

Barrier walls that are formed from a plurality of elongated piles typically are driven into the earth to a depth sufficient to support the panels in an upright attitude. In some cases, the piles are in the form of extruded structural panels and are formed with male and female opposed edges so that similar panels can be locked together at their adjacent edges to form a continuous barrier wall. Because of the strength required of the panels when being driven into the earth and the strength required under load conditions, the panels have been made of steel or aluminum.

In recent years, structural panels have been constructed of polyvinylchloride and other plastics having relatively low tensile and high compression strengths. The panels are extruded in a continuous manufacturing process, and in order to provide the strengths in the panel necessary to withstand the loads that are expected to be applied to the panels, the thicknesses of the panels have been increased over the typical thickness of similar panels formed of steel or aluminum. For example, the modulus of elasticity of polyvinylchloride ("PVC") is estimated at 400,000 psi, whereas the modulus of elasticity of aluminum and steel is estimated at 10,000,000 psi and 30,000,000 to 40,000,000 psi respectively. Therefore, for PVC to achieve the strength characteristics of aluminum, for example, the PVC would be required to be approximately 25 times thicker than the aluminum.

In order to produce a structural panel formed of a synthetic resin that is to be used as a driven pile in the formation of a barrier wall, the panels have been formed in various strengthening cross sectional shapes, such as V shapes, Z shapes, U shapes, etc. so as to provide resistance to bending in response to the application of axial and/or lateral loads to the panels. Further, the panels have been constructed so as to have at their opposite edges male and female locking elements, so that the edge of one panel locks with and supports the edge of an adjacent panel. An example of this type of product is disclosed in U.S. Pat. No. 5,145,287.

After the first panels have been driven into place, subsequent panels can be driven into place adjacent the previously driven panels, by telescopically sliding the female locking element at the edge of the to be driven panels about the exposed male locking element of the previously driven panel, and progressively driving the panels into the earth as the telescoped locking elements progressively guide the panels into place.

The panels usually are from 2–40 feet in length, and while the shapes of the panels are very important in resisting the axial and lateral forces applied to the panels during the driving function, the lower, outer corner of the panels being driven are most vulnerable to bending forces and is most likely to become deformed during the driving procedure.

Although it might be apparent that the distal locking element could be increased in size so as to include enough material to better resist the forces being applied during the driving of the structural panel, the increased thickness of the panel increases the likelihood that the panel will be misshapened during the production process. It is important that the panel be of substantially uniform thickness throughout its entire width so as to cool evenly after it has been extruded, so that warping of the panel will not occur. Therefore, it is impractical to add thickness to the panel at or adjacent the male locking element without affecting the production process and/or the shape of the finished panel.

Therefore, it would be desirable to provide a structural panel for forming barrier walls and the like which can be driven as a pile into the earth, and which would have sufficient strength to withstand the vertical driving forces and the lateral forces that are to be applied to the panel during driving of the panel and after the panel has been placed in its desired position, while minimizing the amount of material in the panel and while forming a panel of symmetrical and uniform thickness shape.

SUMMARY OF THE INVENTION

Briefly described, the present invention comprises a structural panel which is used as a pile for driving into the earth and for forming a continuous barrier that can be used as barrier walls, such as sea walls, dikes, piers, contaminate barriers, and the like. The structural panels are extruded and are of uniform size and shape along their length, which may be 2 to 40 feet or longer, and which are of uniform cross section across their lengths, and are of a stretched Z-shape cross sectional shape, with opposed distal edges formed as male and female interlocking edges for mating adjacent panels together. Each panel includes a pair of opposed flat side sections (sometimes known as "flats") which are disposed in parallel planes and which are disposed longitudinally from each other. A central web section extends between the opposed side sections and forms equal obtuse angles adjacent the inner surfaces of the side sections, thus forming the overall stretched Z-shaped cross section. The distal edges of the opposed side sections are formed with the interlocking male and female locking elements, so that the female locking element can be telescopically moved about the male locking element, thus joining adjacent panels together, as the locking elements guide the panel being installed into place.

A feature of the invention is the strengthening ribs integrally formed on the inner surfaces of both opposed side sections. One of the strengthening ribs is positioned immediately adjacent the male locking element so as to provide additional strength at the distal end of the side section that resists bending of the distal edge of the side section during driving of the panel into the earth. This distal strengthening rib is also sometimes referred to as a driving tongue since it is generally tongue-shaped and provides additional strength for resisting the forces of driving the panel into the earth.

Additional intermediate strengthening ribs are spaced from the distal strengthening rib, so as to be positioned intermediate to the distal strengthening rib and the central web section of the structural panel.

Likewise, the side section that includes at its distal edge the female locking element has intermediate strengthening ribs that are of equal size and shape as the strengthening ribs of the opposite side section.

The strengthening ribs are all of a length sufficient to extend beyond the localized bending plane of the side section to which they are mounted. Thus, when localized bending forces are applied to the side section and the side section is urged so as to tend to bend about its localized bending plane, the portions of the reinforcing ribs that extend beyond the side section bending plane will tend to be in compression instead of in tension, taking advantage of the 100 to 1 advantage of compressive vs. tensile strength, 400,000 vs. 4,000 when creep is considered. Maximum usable tensile strength of load bearing PVC beams must be limited to 4,000 psi to preclude creep failure.

When the shape of the structural panel is considered as a whole, a panel bending plane is formed parallel to the planes of the side sections, and the panel bending plane intersects the central web section intermediate its cross sectional length. The side sections and their respective strengthening ribs and locking elements are of substantially equal cross sectional area and extend equal distances in opposite directions of the central web section, so that equal cross sectional areas and equal cross sectional lengths of the panel on opposite sides of the bending plane are driven into the soil, thereby balancing the panel as it is driven into the soil and resisting any tendency of the panel to tilt or bow as it is being driven.

Since the reinforcing ribs extend at a right angle with respect to the panel bending plane, more resistance to bending forces is provided. The ribs improve the structural rigidity of the panels because the ribs increase the section modulus. The ribs tend to retard stretching of the side sections of the panel, either by adding additional mass of material to the side sections and therefore providing more material which must be stretched, or by being urged into compression if the panel is urged about its localized bending plane.

For example, when a panel is being driven or is in place and is encountering lateral forces, it is typical that the outside side section and the portion of the central web section adjacent the outside section are placed under tensile stress loading, whereas the rest of the panel, including the inside side section and its adjacent portion of the central web section, are placed under compressive stress loading. Since the reinforcing ribs extend at a right angle with respect to the bending plane, the ribs provide substantially increased resistance to both tensile stress loading and compressive stress loading. While additional material could be added to the outside side section to resist the tension, the reinforcing ribs provide much greater resistance to tension due to the fact that they extend at a right angle with respect to the bending plane of the panel.

Since the cross sectional configuration of the panel is balanced on opposite sides of its bending plane, the panel can be reversed so as to place either of its opposed side sections to the outside of the wall structure. Also, alternate ones of the panels can be reversed end-for-end so as to form a zigzag pattern or a pattern of a series of U-shapes.

Thus, it is an object of this invention to provide a structural panel for forming barrier walls and the like fabricated of synthetic resin material for use as a pile for driving into the earth, with reinforcing ribs applied to side sections of the panel to improve the structural rigidity of the panel, by increasing the overall section modulus of the panel.

Another object of this invention is to provide a structural panel formed of synthetic resin material for use as a pile to form a barrier wall, which includes reinforcing strengthening ribs which are oriented perpendicular to the bending plane of the panel, so as to provide additional resistance to tension and compression in response to bending forces being applied to the panel.

Another object of this invention is to provide a structural panel formed of a synthetic resin which is used as a pile for forming barrier walls, and which has opposed side sections and a central web section formed in a stretched Z-shape, with ribs applied to the inside surfaces of the side sections, with the ribs extending from the side sections across the local bending plane of the side sections so as to utilize the compressive strength of the ribs to reduce the deflection of the side sections.

Another object of this invention is to provide an improved structural panel for use as a pile in forming barrier walls and the like which is extruded and which is formed with substantially uniform thickness and which includes shapes that provide improved resistance to bending forces.

Other objects, features and advantages of the present invention will become apparent upon reading the following specifications, when taken in conjunction with the accompanying drawings.

DETAILED DESCRIPTION

Figure 1:
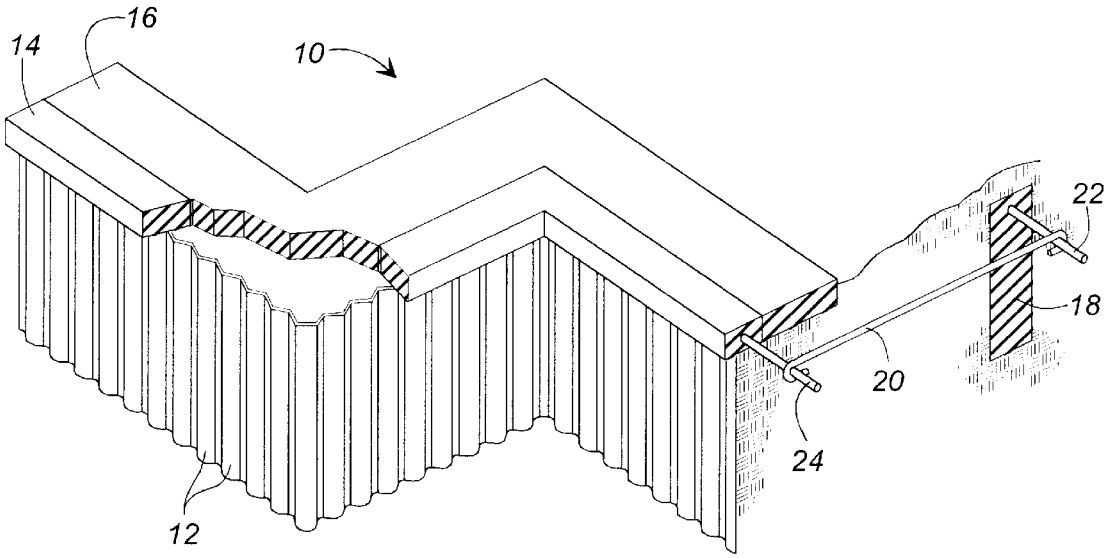
FIG. 1 is a perspective illustration of a portion of a sea wall, with parts broken away, showing how the structural panels are assembled in edge-to-edge relationship in the sea wall.

Referring now in more detail to the drawings, in which like numerals indicate like parts throughout the several views, FIG. 1 illustrates a wall structure, such as a sea wall, which is assembled from a series of structural panels 12 that are arranged in edge-to-edge, interlocked relationship. The structural panels are driven in pairs vertically into the soil beneath the body of water (not shown), and a poured concrete cap 14 is formed on the upper edges of the assembled panels, with the upper edges of the panels being embedded in the concrete cap. Other types of caps can be used, as may be desired, so as to hold the top edge of the wall in a static condition. An adjacent platform, such as concrete strip 16, can be formed behind cap 14, so as to reinforce the structure and prevent ground erosion behind the structure. A concrete anchor 18 of poured concrete can be spaced behind the wall structure 10 and extends generally parallel to the wall structure. A tie rod 20 is connected at its ends to reinforcing rods 22 and 24 that are embedded in the anchor 18 and cap 14, to assist in holding the wall in an upright attitude. A plurality of tie rods 20 extend from the anchor 18 to the cap 14 at intervals along the length of the wall structure 10.

Figure 2:
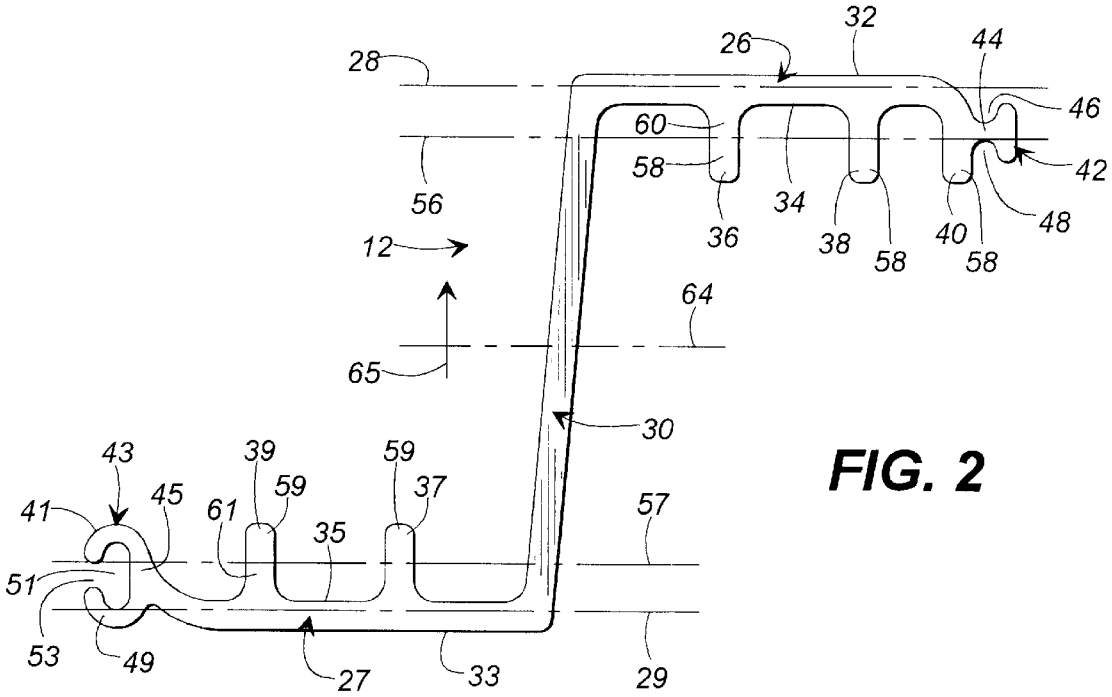
FIG. 2 is a cross sectional view of a structural panel.
Figure 3:
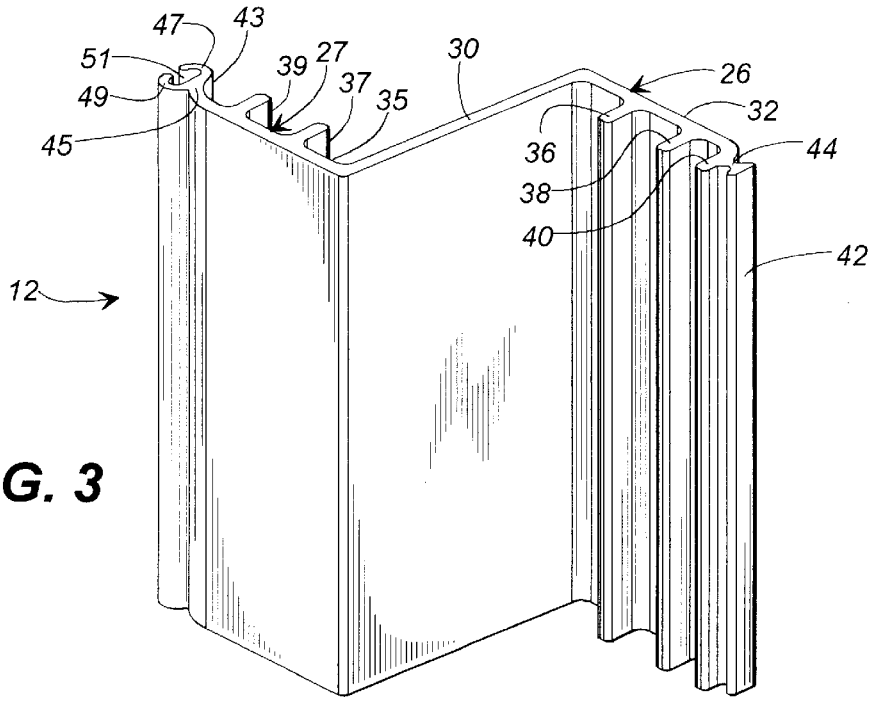
FIG. 3 is a perspective illustration of a portion of a structural panel.

FIGS. 2 and 3 illustrate one of the structural panels 12. Each structural panel is formed of a polyvinylchloride ("PVC") or other suitable synthetic or polymer, such as that sold by B.F. Goodrich Corporation under the name "Geon", a trademark of B.F. Goodrich. This type of resin has been found to be strong and highly resistant to adverse weather conditions, and includes properties that adequately resist abrasion from sand and other articles carried by water and air, resists deterioration due to ultra-violet radiation, and withstands the bending and compressive forces normally encountered under such conditions, as well as under the conditions when the structural panels are used as piles and are driven into the ground.

The structural panels 12 are approximately stretched Z-shaped and are extruded lengthwise so as to form a constant, uniform cross section from end to end. Each panel includes in cross section a pair of opposed side sections 26 and 27, and a central web section 30 extending between the opposed side sections. The opposed side sections are parallel to each other, and lie in parallel planes 28 and 29, respectively. The opposed side sections are longitudinally displaced from each other along their respective planes 28 and 29, and each opposed side section includes an outer surface 32 and 33, respectively, and an inner surface 34 and 35, respectively. A plurality of strengthening ribs 36, 38 and 40 extend inwardly from the inner surface 34 of side section 26, and similar strengthening ribs 37 and 39 extend inwardly from inner surface 35 of side section 27. A male locking element 42 is supported by a connector section 44 to the last or distal strengthening rib 40. The connector section is attached to strengthening rib 40 intermediate to its length, so as to displace the male locking element 42 from the outer surface 32 of side section 26, forming recesses 46 and 48 on opposite sides of connector section 44 between male locking element 42 and distal strengthening rib 40. Male locking element 42 is of a larger breadth than its connector section 44.

Female locking element 43 includes a base 45 that extends at a right angle with respect to the plane 29 of side section 27, and gripping arches 47 and 49 that form a locking recess 51. The locking recess 51 defines an opening 53. The opening 53 is sized and shaped to receive the connector section 44 while the locking recess is sized and shaped to receive the male locking element 42.

Figure 4:
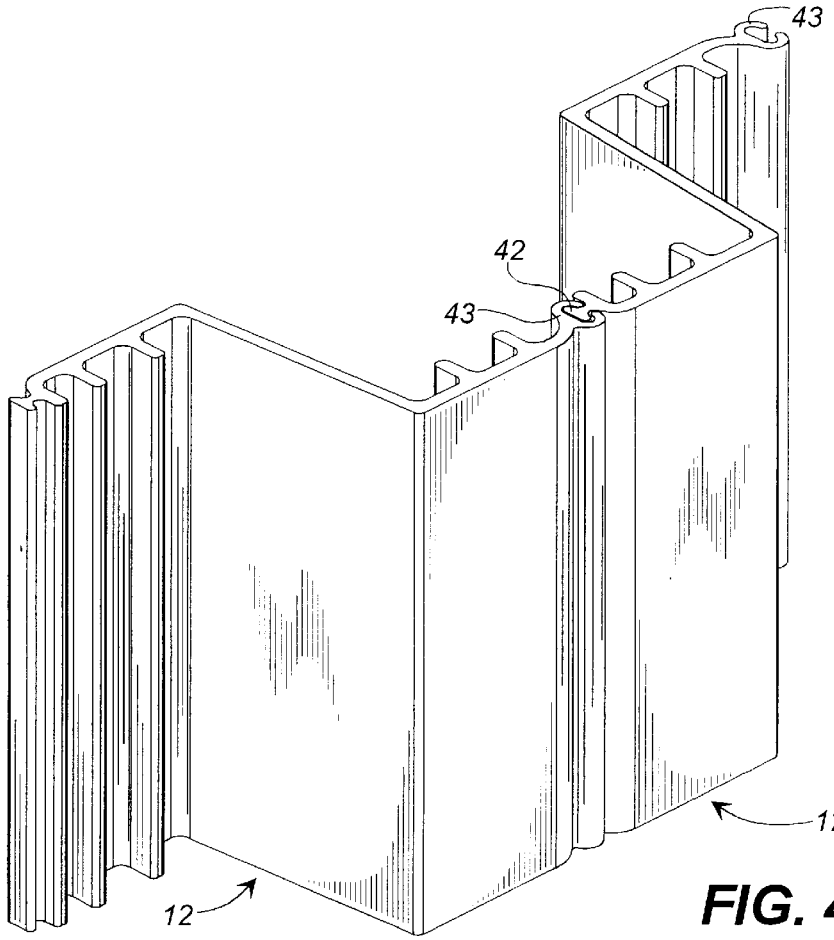
FIG. 4 is a perspective illustration of adjacent structural panels with their locking elements attached.

Both the male locking element 42 and female locking element 43 are displaced inwardly with respect to their opposed side sections 26 and 27, so that a substantially continuous surface is formed between adjacent ones of the structural panels 12, as shown in FIG. 4.

The distal strengthening rib 40, male locking element 42 and connector section 44 are of approximately the same cross section as the female locking element 43, which includes its gripping arches 47 and 49 and base 45.

The opposed side sections 26 and 27, their respective strengthening ribs 36–40 and their locking elements 42 and 43 respectively define side section bending planes 56 and 57 that are disposed substantially parallel to the side sections 26 and 27, and displaced inwardly of the side sections. These are the localized planes about which the side sections 26 and 27 would bend when lateral forces are applied that bow the side sections outwardly, away from central web section 30 at a position intermediate to the lower and upper ends of the structural panel.

Strengthening ribs 36–40 and locking elements 42 and 43 all extend from one side to the other side of their respective side section bending planes 56 and 57. With this arrangement, when a side section, such as side section 26, has lateral stresses applied to it, typically from the inside toward the outside of the side section as indicated by direction arrow 65, the distal portions 58 of the reinforcing ribs that extend inwardly beyond the side section bending plane 56 will be compressed, while the proximal portions 60 of the strengthening ribs as well as the side section 26 will be in tension. Since PVC and other synthetic resins have greater compression strength than tensile strength, the placement, shape and length of the ribs extending away from the side section provides an important strength contribution to the side section, so that the side section is able to withstand increased lateral loads. Likewise, the portions of the male locking element 42 that span the side section bending plane 56 aid in resisting bending forces in the same way.

A panel bending plane 64 extends between opposed side sections 26 and 27, parallel to the planes 28 and 29 of the side sections, intersecting the central web section 30 halfway of its cross sectional length. When bending forces are applied to the structural panel 12 so as to bend both side sections in a uniform direction extending laterally of their lengths, as indicated by direction arrow 65, side section 26 will have tension forces applied to it, while opposed side section 27 will have compression forces applied to it. The positions of the strengthening ribs 36, 38 and 40 and of male locking element 42, as well as the shapes of these elements which extend at a right angle with respect to the panel bending plane 64 significantly add additional strength to the panel in resisting both tension forces and compression forces. The tension forces will be experienced by side section 26, including its strengthening ribs and locking element and by the adjacent portion of the central web section 30, while the elements on the opposite side of the panel bending plane 64 will be in compression. The added resistance of the strengthening ribs 37, 39 and the female locking element 43 in resisting the bending of the compression side of the structural panel, provides additional strength to the central web section 30.

It will be noted that the distal edges of the opposed side sections are reinforced with the locking elements 42 and 43, and with side section 26 having its distal strengthening rib 40 placed immediately adjacent the male locking element. This places a sufficient mass of material at the distal ends of the structural panel so that the distal ends are additionally reinforced to withstand bending and axial loads. Likewise, the proximal ends of the opposed side sections are reinforced by the central web section 30, with additional strengthening ribs 36, 38, and 37, 39 being spaced along their respective side sections for intermediate strength.

Central web section 30 is angled at approximately 85° with respect to the inner surfaces 34 and 35 of opposed side sections 26 and 27, respectively. While other angles could be used, it is desirable that the intersection of the central web section 30 with the side sections 26 and 27 be close to a right angle so as to provide a maximum amount of space between opposed side sections while using a short cross sectional length of the central web section and provide a maximum amount of strength from the central web section to the opposed side sections.

FIG. 4 illustrates a pair of structural panels 12 positioned in side-by-side interlocked relationship, with the female locking element 43 telescopically engaged with the male locking element 42. Typically, when the panels are to be driven into the earth at the construction site, a pair of panels are assembled as illustrated in FIG. 4, and then the panels are positioned above and adjacent the previously installed panels with the female locking element 43 positioned above the male locking element of the previously installed adjacent panel. The panels being installed are then moved downwardly so that the female locking element 43 guides itself along the length of male locking element 42 of the adjacent previously installed panel, and the panels are progressively moved downwardly by driving, vibration, gravity, or other external forces, until the upper ends of the panels become located at approximately the desired height. If necessary, the upper ends of the panels that cannot reach the desirable height can be cut away. After the wall structure has been assembled in this manner, the cap 14 (FIG. 1) is applied to the upper ends of the assembled panels.

While FIG. 4 shows a pair of panels 12 assembled to form a U-shape with wings at the upper edges of the U, one of the panels 12 can be rotated end-for-end, so that a zigzag or stair step shape can be formed by the same panels.

Figure 5:
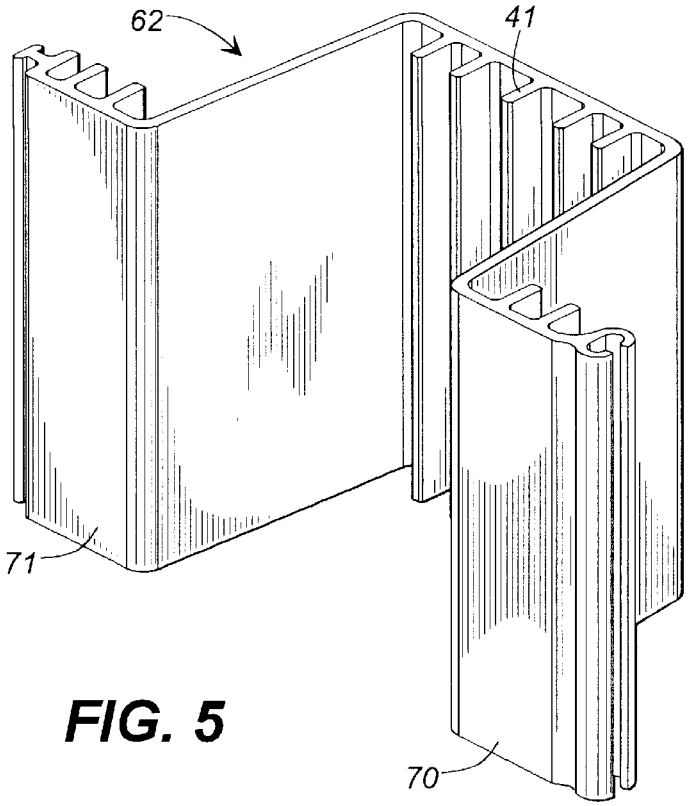
FIG. 5 is a perspective illustration of a second embodiment of the structural panel, with adjacent Z-shaped structural panels formed as a unitary panel.

Moreover, as illustrated in FIG. 5, if the winged U-shaped panels of FIG. 4 are desired, the adjacent panel shapes can be integrated into a single shape 62. The base of the U-shape of the pair of panels is integrated into a single shape, with a centrally located strengthening rib 41 replacing the male and female locking elements.

Figure 6:
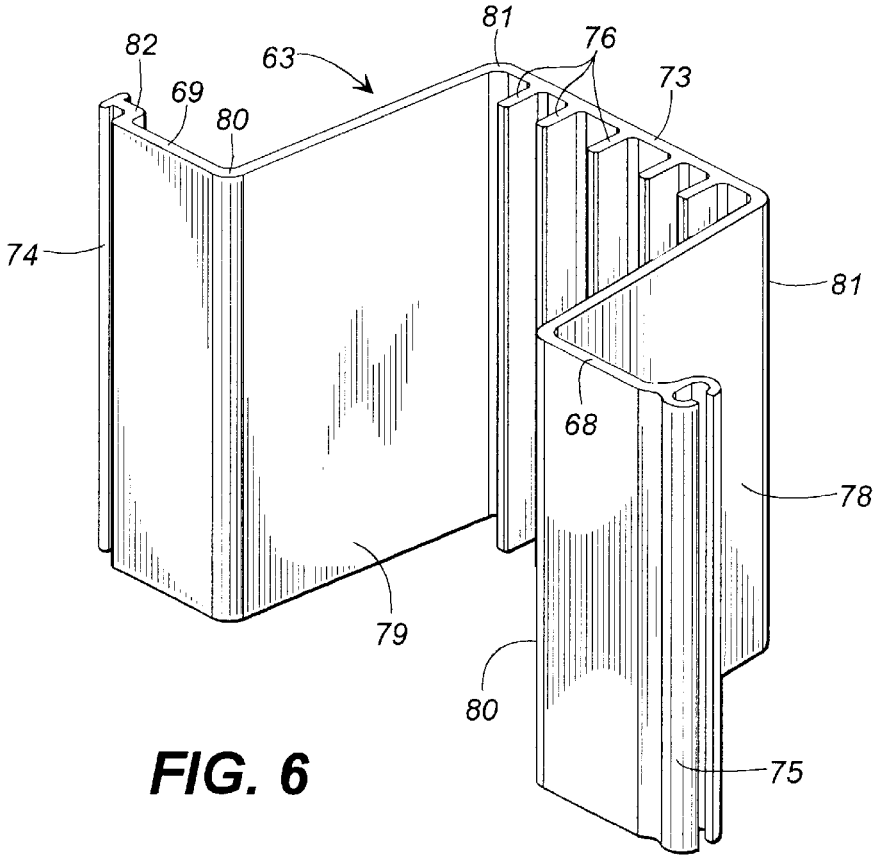
FIG. 6 is a perspective illustration of a third embodiment of the structural panel, similar to FIG. 5, but eliminating the strengthening ribs along the side sections.

FIG. 6 illustrates another integrated panel shape 63 which includes the reinforcing ribs at the base of the winged U-shape, but omits the reinforcing ribs on the side sections 68 and 69 adjacent the male and female locking elements 74 and 75. The placement of the ribs 76 on the base section 73 functions to reinforce the portion of the structural panel 63 that has the longest span and which would otherwise be more vulnerable to bending, bowing, etc. The male and female locking elements 74 and 75 tend to rigidify the side sections 68 and 69. In general, the overall shape of structural panels 62 and 63 is that of a stretched winged U-shape, with the base section 73 and the central web sections 78 and 79 forming the legs of the U-shape, the base section 73 forming the base of the U-shape, and with the side sections 68 and 69 forming the wings of the winged U-shape. The side sections 68 and 69 occupy a common plane, and the ribs of the side sections of FIG. 5 face the base section, while the ribs of the base section face the side sections 70 and 71. The central web sections each have opposed parallel edge portions 80 and 81 joined to the proximal edges of the side sections 68 and 69, and to the base section 73.

When the structural panels of FIGS. 5 and 6 are to be driven into the earth, the female locking element 75 will engage the male locking element 74 of an adjacent identical structural panel, so that the locking elements tend to reinforce and strengthen the structural panel as it is installed. Further, the offset section 82 between the male locking element 74 and the side section 69 strengthens the side section, in the same manner as the strengthening ribs of FIGS. 2–5 strengthen their respective side sections.

By using the strengthening ribs 36–40 of FIGS. 1–4 and the strengthening rib 41 of FIG. 5, a minimal amount of additional material is added to the overall structural panel while maximizing the strength added to the panel. The ribs improve the structural rigidity of the PVC sheet piling by increasing the overall section modulus of the sheet piling. The ribs significantly improve upon the strength characteristics of the structural panels because the ribs are oriented perpendicular to the bending planes. The inward portions of the ribs are put in compression as the structural panels flex under localized loading of the opposed side sections, when the opposed side sections are about to bow or bend. Utilizing the compressive strength of the PVC material, which is approximately 100 times greater than the tensile strength, reduces the deflection of the flat opposed side sections, which tends to reduce the tensile stresses developed in the opposed side sections for a given load. Thus, it can be seen that the invention takes advantage of the characteristics of PVC to be stronger in compression than in tension.

Since the structural panel is geometrically balanced on opposite sides of its panel bending plane 64, there should be equal differential heat retention of the panel on both sides of the panel bending plane 64, so as to avoid bowing of the panel during production and to minimize the stresses induced in the panel from differential rates of shrinking. Also, the placement of the distal strengthening rib 40 immediately adjacent the male locking element 42 achieves the advantage of increasing the rigidity of the free edge of the panel as the panel is being driven into the earth. The other distal edge of the panel at the female locking element 43 is stabilized by being connected to the male locking element of the adjacent previously installed panel when the panel is being driven into the ground; however, the male locking element 42 and the adjacent distal strengthening rib 40 must be strong enough to stabilize their shapes by themselves during the driving function. The right angle orientation of the distal strengthening rib 40 rigidifies the distal edge of the side section 26 and the strengthening rib 40 tends to function as a driving tongue that resists bending of the distal end of side section 26.

Since the structural panel 12 is symmetrically balanced on opposite sides of its panel bending plane 64, the driving resistance between the structural panel and the soil into which it is being driven during installation does not tend to tilt the panel. Because of the additional rigidity of a panel created by the strengthening ribs 36–40, the panel has less tendency to bow during driving and more driving forces can be transferred from the driving implement vertically through the panel to the lower edge or tip of the panel.

It will be understood that FIGS. 3–6 of the drawings show relatively short lengths of the structural panels. However, a typical structural panel is between 2 and 40 feet in length and is 1 to 2 feet in cross sectional width, from distal edge to distal edge.

Although preferred embodiments of the invention have been disclosed in detail herein, it will be obvious to those skilled in the art that variations and modifications of the disclosed embodiment can be made without departing from the spirit and scope of the invention as set forth in the following claims.

What is claimed is:

1. A structural panel for forming sea walls, barrier walls and the like, fabricated of synthetic resin material for driving into the earth and for resisting deterioration from sand abrasion, water movement and other severe environmental conditions, comprising:

said panel being elongated and of constant size and shape along its length and characterized by having been extruded length wise;

said panel including in cross section:

first and second opposed side sections disposed in parallel planes and displaced longitudinally from each other and each said side section including an inner surface facing the plane of the other side section and an outer surface facing away from the plane of the other side section and a distal edge and a proximal edge, and a central web section having opposed parallel edge portions joined to said proximal edges of said side sections;

said central web section and said first and second opposed side sections forming obtuse angles at said inner surfaces;

the distal edge of said first side sections being formed in a laterally protruding male locking element and the distal edge of said second side sections being formed in a female locking element sized and shaped to substantially surround and lock with said male locking element so that adjacent ones of the structural panels can be locked together at their distal edges to form a wall; and a strengthening rib integrally formed on said first side section, said strengthening rib having a length and a width, with the length of said rib extending at a right angle from the inner surface of said first side section at a position adjacent said laterally protruding male locking element and forming with said laterally protruding male locking element a recess for receiving a portion of said female locking element.

2. The structural panel of claim 1, wherein:

said side sections and said central web section and said strengthening ribs are of approximately equal thickness, so that differential heat retention in the manufacturing process is retarded.

3. The structural panel of claim 1, wherein:

said male locking element includes a locking protrusion of a thickness greater than the thickness of its side section and a connector section of a thickness less than the thickness of said locking protrusion and extending from said locking protrusion to said strengthening rib so that said locking element is supported by said strengthening rib.

4. The structural panel of claim 3, wherein:

said male locking element, said connector section and said strengthening rib from which said male locking element extends are approximately equal in cross sectional area to the cross sectional area of said female locking element so that the distal edges of said panel are of approximately equal cross sectional area.

5. The structural panel of claim 4, wherein:

said male locking element and said female locking element are positioned with respect to their respective side sections so as to align the side sections of adjacent ones of the structural panels when adjacent ones of said structural panels are connected together by their respective male and female locking elements.

6. The structural panel of claim 1, and further including:

a plurality of spaced strengthening ribs integrally formed on the inner surface of both said first and second side sections.

7. The structural panel of claim 6, wherein:

said plurality of strengthening ribs are of substantially equal size and shape.

8. The structural panel of claim 6, wherein:

said side sections and said ribs have a side section bending plane displaced from each side section toward the opposite side section, with said side section bending planes each being in a plane parallel to the plane of its side section, and said ribs extending at a right angle from said side sections a distance to reach from said side sections beyond said side section bending planes, so that when bending forces are applied to said side sections for bending the side sections about said side section bending planes, the portions of said strengthening ribs on one side of said side section bending planes will be in compression and the portions of said ribs on other side of said side section bending planes will be in tension.

9. The structural panel of claim 1, wherein:

said structural panel has a panel bending plane intersecting said central web intermediate said opposed parallel edge portions and extending parallel to the planes of said side sections, with the portions of said panel on one side of said panel bending plane being of substantially equal in cross sectional area to the cross sectional area of the portions of said panel on the other side of said panel bending plane.

10. A structural panel for forming sea walls, barrier walls and the like, fabricated of synthetic resin material for driving into the earth comprising:

said panel being elongated and of constant size and shape along its length and characterized by having been extruded length wise;

said panel including in cross section:

a pair of opposed side sections and each side section including an inner surface facing the other side section and an outer surface facing away from the other side section and a distal edge and a proximal edge, and a central web section having opposed parallel edge portions joined to said proximal edges of said side sections;

said central web section and said opposed side sections forming a stretched Z-shape;

the distal edge of one of said side sections being formed in a male locking element and the distal edge of the other of said side sections being formed in a female locking element sized and shaped to lock with said male locking element so that adjacent ones of the structural panels can be locked together at their distal edges to form a wall; and a plurality of strengthening ribs integrally formed on each side section, said ribs each having a length and a width, with the length of each rib extending at a right angle from the inner surface of each side section between said distal edge and said central web section, said male locking element including a locking protrusion mounted to one of said strengthening ribs so that said locking protrusion is supported by a strengthening rib, said strengthening ribs, side sections and said central web section being of substantially equal thickness.

11. The structural panel of claim 10, wherein:

said side sections and said ribs have a side section bending plane displaced from each side section toward the opposite side section, with said side section bending planes each being in a plane parallel to the plane of its side section, and said ribs extending at a right angle from said side sections a distance to reach from said side sections beyond said side section bending planes, so that when bending forces are applied to said side sections for bowing the side sections about said side section bending planes, the portions of said strengthening ribs on one side of said side section bending planes will be in compression and the portions of said ribs on other side of said side section bending planes will be in tension.

12. The structural panel of claim 10, wherein:

said structural panel has a panel bending plane intersecting said central web intermediate said opposed parallel edge portions, with the portions of said panel on one side of said panel bending plane being of substantially equal in cross sectional area to the cross sectional area of the portions of said panel on the other side of said panel bending plane.

13. A structural panel for forming sea walls, barrier walls and the like, fabricated of synthetic resin material for driving into the earth comprising:

said panel being elongated and of constant size and shape along its length and characterized by having been extruded length-wise;

said panel being of stretched U-shaped with side wings and including in cross section:

a pair of side sections occupying a common plane and forming the wings of said shape, a base section, each side section including an inner surface facing said base section and said base section including an inner surface facing said side sections, said side sections each including a distal edge and a proximal edge, and central web sections each having opposed parallel edge portions joined to one of said proximal edges of said side sections and to said base section;

the distal edge of one of said side sections being formed in a male locking element and the distal edge of the other of said side sections being formed in a female locking element sized and shaped to lock with said male locking element so that adjacent ones of the structural panels can be locked together at their distal edges to form a wall;

a plurality of strengthening ribs integrally formed on said inner surface of said base section, said ribs each having a length and a width, with the length of each rib extending at a right angle from the inner surface of said base section, said strengthening ribs, side sections, base section and said central web sections being of substantially equal thickness; and said male locking element including a locking protrusion mounted to one of said strengthening ribs so that said locking protrusion is supported by a strengthening rib.

14. The structural panel of claim 13, wherein said inner surfaces of said side sections include strengthening ribs.

* * * * *